US005564584A

United States Patent [19]

Raboin et al.

[11] Patent Number: 5,564,584

[45] Date of Patent: Oct. 15, 1996

[54] VENT CAP FOR DISCHARGING NEARLY EMPTY PROPANE CYLINDERS

[75] Inventors: Ronald Raboin, DePere; Dallas Schwalenberg, Potter, both of Wis.

[73] Assignee: Western Industries, Inc., Chilton, Wis.

[21] Appl. No.: 372,767

[22] Filed: Jan. 13, 1995

[51] Int. Cl.[6] ..... B65D 51/16

[52] U.S. Cl. ..... 220/203.07; 220/203.29; 220/367.1; 220/DIG. 16; 116/266; 137/557

[58] Field of Search ..... 220/203.04, 203.05, 220/203.07, 203.09, 203.10, 203.25, 203.29, 240, 360, 367.1, 366.1, 89.1, DIG. 16, DIG. 17; 215/17, 18, 28, 260, 270, 271; 137/557, 553; 116/34 B, 34 R, 266, 272, 220, 279

[56] References Cited

U.S. PATENT DOCUMENTS

| | | | |
|---|---|---|---|
| 1,223,252 | 4/1917 | Branz . | |
| 2,635,630 | 4/1953 | Cornelius | 137/525 |
| 2,850,900 | 9/1958 | Billington | 73/406 |
| 2,990,971 | 7/1961 | Enell | 220/203.07 |
| 3,031,165 | 4/1962 | Allen | 251/111 |
| 3,203,445 | 8/1965 | McCormick | 220/203.07 X |
| 3,757,987 | 9/1973 | Marshall | 220/44 |
| 3,810,390 | 5/1974 | Neugebauer | 116/266 X |
| 3,930,592 | 1/1976 | Dilanni | 220/270 |
| 4,174,673 | 11/1979 | Tung et al. | 116/34 R |
| 4,249,670 | 2/1981 | Hug | 220/295 |
| 4,265,752 | 5/1981 | O'Banion | 210/172 |
| 4,451,095 | 5/1984 | Chichester et al. | 303/71 |
| 4,484,691 | 11/1984 | Lees | 220/89 A |
| 4,575,390 | 6/1987 | Harris | 220/203 |
| 4,736,863 | 4/1988 | Harris | 220/203.07 X |
| 4,779,755 | 10/1988 | Harris | 220/203 |
| 4,836,443 | 6/1989 | Wolters et al. | 236/92 C |
| 4,881,657 | 11/1989 | Capasso | 220/303 |
| 4,887,733 | 12/1989 | Harris | 220/203 |
| 4,899,684 | 2/1990 | Houžvic et al. | 116/272 |
| 5,014,643 | 5/1991 | Huang | 116/272 X |
| 5,086,814 | 2/1992 | Sato et al. | 141/65 |
| 5,108,001 | 4/1992 | Harris | 220/203 |
| 5,197,622 | 3/1993 | Anderson | 220/89.2 |

*Primary Examiner*—Allan N. Shoap
*Assistant Examiner*—Nathan Newhouse
*Attorney, Agent, or Firm*—Foley & Lardner

[57] ABSTRACT

The invention provides a vent cap for automatically discharging a gas container such as a propane cylinder. The vent cap includes threads for securing the vent cap to the neck of the gas container. The vent cap further includes an indicator which has a pin and a button. When the button is manually depressed, the pin engages the valve stem of the check valve which seals the gas container, discharging gas from the container. The button includes a flexible, radially curved central portion which provides oil can action when the indicator is moved between the up position and the down position. A geometrical configuration of the central portion may be adjusted to vary the gas pressure threshold at which the indicator will remain in the down position to automatically discharge a nearly empty gas container.

20 Claims, 2 Drawing Sheets

VENT CAP FOR DISCHARGING NEARLY EMPTY PROPANE CYLINDERS

BACKGROUND OF THE INVENTION

The invention relates generally to a cap for a container sealed by a valve. The invention more particularly relates to a cap for a container used to store pressurized materials such as a propane cylinder which stores propane under pressure. The cap allows discharge of the remaining material contained in the cylinder after the contents of the cylinder fall below a predetermined threshold.

Propane is a volatile chemical commonly used as a fuel. Propane is readily stored under pressure as a liquid. When released from pressurized storage, the liquid propane changes to a gas which may be burned in a controlled manner to provide heat and light and to satisfy other needs.

Propane is commonly stored in a metal cylinder at a pressure of approximately 150 pounds per square inch (PSI), at which pressure the propane remains in a liquid state at normal operating temperatures. Typically, the metal cylinder has a neck terminating in a mouth fitted with a check valve. The check valve may be opened to initially fill the cylinder with propane. The check valve is spring-loaded and remains closed in response to the pressure provided by the spring and the pressurized propane in the cylinder. The closed check valve retains the propane in the cylinder. The cylinder further includes a relief valve to vent propane in the event of excessive pressure.

The neck of the cylinder is adapted to be engaged by an appliance, such as a torch fixture, camp stove, lantern or the like. An appliance designed to fit the neck includes a release valve for providing controlled release of gaseous propane from the cylinder for use by the appliance. When the appliance is affixed to the cylinder, the appliance opens the check valve so that flow of gas from the cylinder is controlled by the release valve. The appliance forms a gas tight seal with the neck of the cylinder.

A user of the propane cylinder can generally determine the approximate fill level of the cylinder by lifting or shaking the cylinder. Shaking or sloshing of the liquefied propane within the cylinder provides a detectable indication that a usable amount of propane remains in the cylinder. When the cylinder is nearly empty and all of the liquefied propane has been changed to gas, the user will no longer detect the sloshing of the liquid and may determine that the cylinder is empty. When all of the contents have changed to gas, the propane cylinder may lack sufficient gas pressure to properly operate an appliance. Such empty or nearly empty cylinders are discarded by the user.

Such empty cylinders may be recycled to reclaim the metal used to fabricate the cylinder. Recycling propane cylinders is desirable to reduce the manufacturing cost of cylinders and to reduce the usage of natural resources. Recycling includes removing components such as the relief valve and the check valve and then crushing the cylinder.

Recycling or otherwise handling discarded containers used to store propane or other volatile gases can be dangerous if the discarded container retains some of the hazardous material. The mere presence of flammable material such as propane within the cylinder creates a risk of fire or explosion.

If the material within the container is under pressure, there is an additional handling risk created. For example, when recycling propane containers, current practice involves first extracting the relief valve to empty the cylinder. If the cylinder retains propane under substantial pressure, portions of the extracted relief valve may be propelled with great energy from the cylinder and create a hazard to personnel. The cylinder is more safely handled when it is empty of the volatile gas or when the gas has been discharged so that the pressure of the gas is substantially equal to atmospheric pressure. Accordingly, there is a need in the art for a device which can safely discharge a cylinder containing a pressurized fluid.

However, the discharge of the pressurized fluid from a nearly empty cylinder must be controlled. Even though a user determines that-a propane cylinder no longer contains liquid propane, the gaseous propane remaining within the cylinder may still be at pressure as great as 150 PSI. Discharge of propane at this high pressure creates a fire and handling hazard. The cylinder should not be discharged until the pressure is reduced to, for example, 60 PSI.

Accordingly, there is a further need in the art for a device which will discharge a cylinder containing a pressurized fluid only when the pressure of the fluid falls below a predetermined level.

SUMMARY OF THE INVENTION

The invention therefore provides a cap for a gas container such as a propane cylinder which has a neck ending in a mouth and a check valve for sealing the mouth. The check valve includes a valve stem which is moveable between a sealing position and a discharging position. To safely discharge the gas from the container, the cap includes fixation means for engaging the neck and securing the cap thereto and an indicator moveable between a first or up position and a second or down position, the indicator including a pin which moves the valve stem from the sealing position when the indicator is in the second position. The indicator remains in the second position when the fluid pressure of the gas is less than a predetermined pressure and safely discharges the gas from the container.

The indicator also includes a button. Depressing the button moves the pin axially from a first or upmost position to a second or downmost position. The button includes a flexible portion which is radially curved to provide an over-center or "oil can" effect. When the button is depressed and the pin is in the second position, the flexible portion is concave when viewed from above the container and provides a visual indication that the container is discharged. When the button is not depressed, for example, when the fluid pressure of gas in the container forces the valve shut and prevents the pin from moving to the second position, the button is convex when viewed from above the container and provides a visual indication that the container may not be discharged.

It is therefore an object of the present invention to provide a vent cap for a gas container such as a propane cylinder which allows remaining gas to be safely discharged from the container.

It is a further object of the present invention to provide a vent cap which discharges remaining gas from the container only when the pressure of the remaining gas is below a predetermined gas pressure.

It is a still further object of the present invention to provide a vent cap which automatically stops discharging gas from the container if the pressure of the remaining gas is not below the predetermined gas pressure to prevent unsafe discharge of large amounts of gas at high pressure.

It is a still further object of the present invention to provide a vent cap which provides an indication of the discharge status of the container so that a person may readily determine if the container is discharged of gas.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in the several figures of which like reference numerals identify identical elements, and wherein:

DETAILED DESCRIPTION OF THE PREFERRED EMBODIMENT

Referring now to FIGS. 1–8, they illustrate a vent cap 10 according to the present invention shown in conjunction with a propane cylinder 12 of the type well known in the prior art. The cylinder 12 is commonly used for storing propane or other fluid at pressure, such as 150 pounds per square inch (PSI). At this pressure, propane remains in a liquid state at normal operating temperatures. When the propane is released from the cylinder, the liquid propane changes to a gas.

Figure 1:
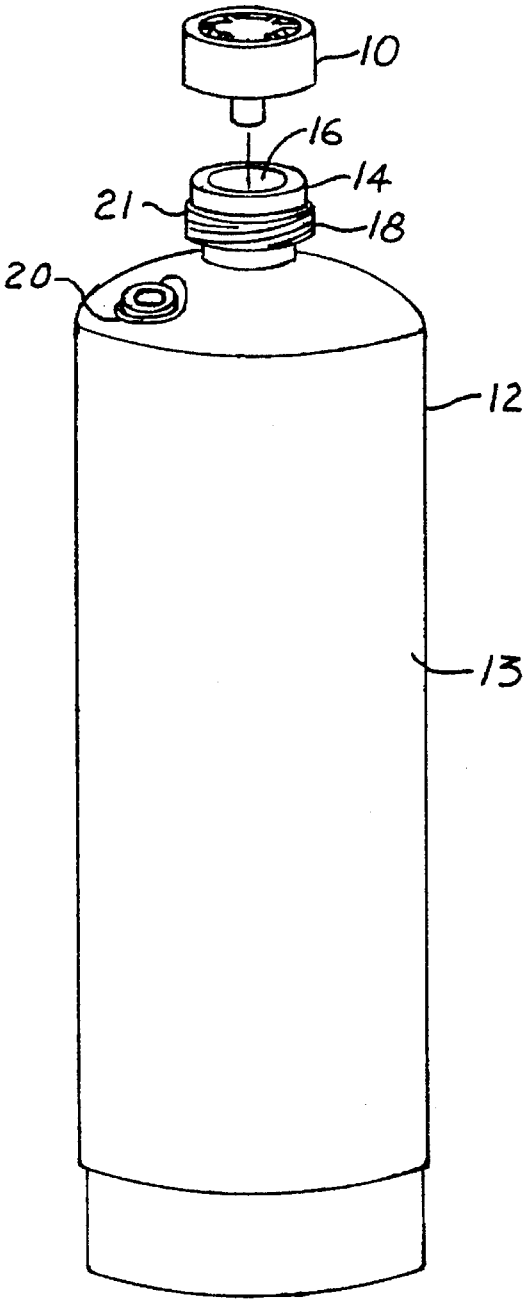
FIG. 1 is a perspective view of a vent cap according to the present invention shown in conjunction with a prior art gas container.
Figure 2:
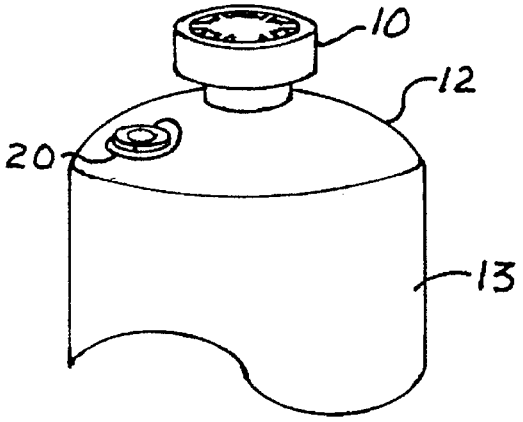
FIG. 2 is a perspective view of a vent cap according to the present invention shown secured to a prior art gas container.
Figure 3:
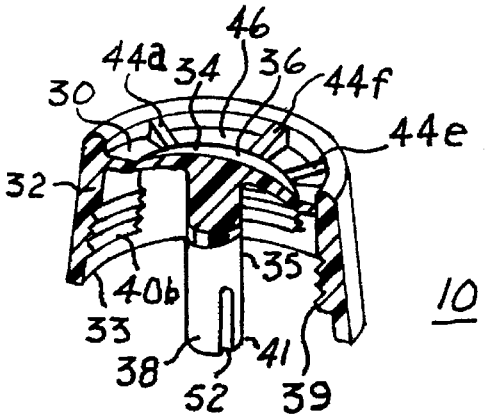
FIG. 3 is a perspective view in partial cutaway of the vent cap of FIGS. 1 and 2.
Figure 4:
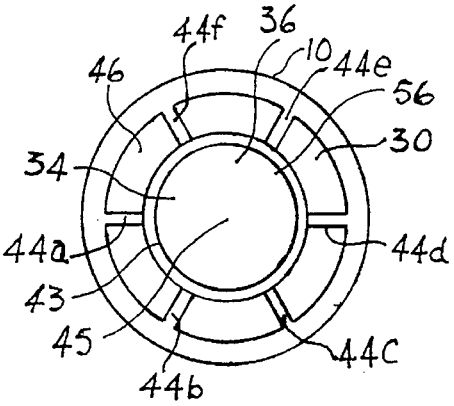
FIG. 4 is a top view of the vent cap of FIGS. 1 and 2.

As illustrated in FIGS. 1 and 2, the propane cylinder 12 includes a body 13 terminating in a neck 14. The body 13 is preferably fabricated from metal such as steel to provide strength and light weight. The neck 14 terminates in a mouth 16 and includes threads 18 along the outer perimeter 21 of the neck 14. Thus, the neck 14 of the cylinder 12 is adapted to be engaged by an appliance, such as a torch fixture, camp stove, lantern or the like, by screwing the appliance onto the neck 14 using the threads 18 and forming a gas-tight seal. The body 13 also includes a relief valve 20 for releasing gas from the cylinder 12 when pressure within the cylinder 12 exceeds a predetermined level. For prior art containers such as propane cylinder 12, the dimensions and manner of attachment of the neck 14 to an appliance are defined according to industry standards.

Figure 7:
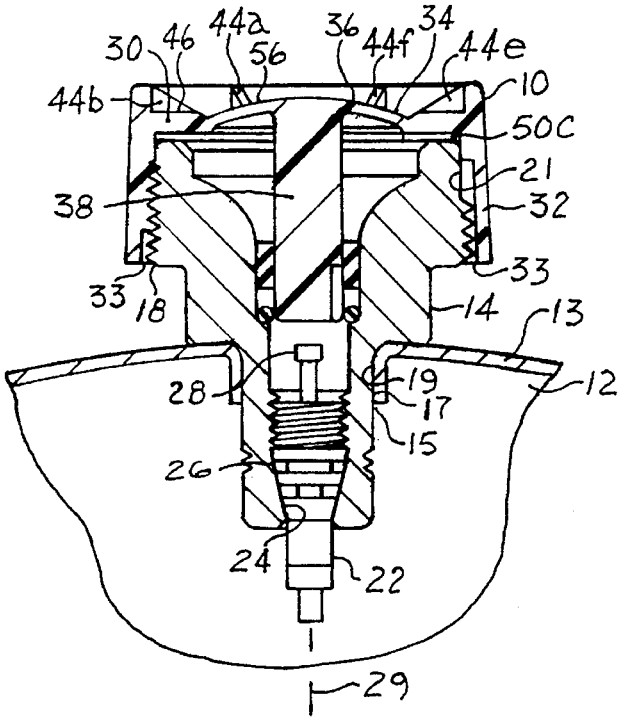
FIG. 7 is a cross-sectional view taken along line 6—6 in FIG. 5 of the vent cap of FIG. 2 showing the vent cap in a first configuration.
Figure 8:
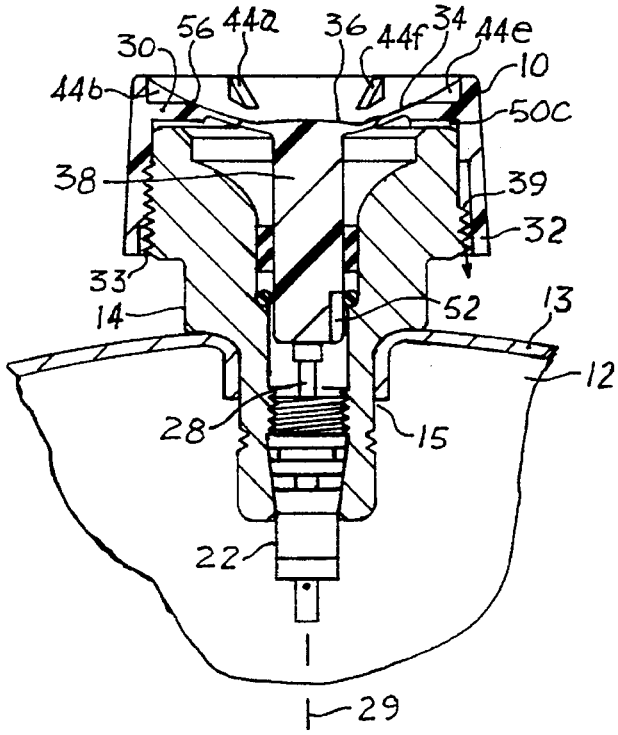
FIG. 8 is a cross-sectional view taken along line 6—6 in FIG. 5 of the vent cap of FIG. 2 showing the vent cap in a second configuration.

As illustrated in FIGS. 7 and 8, the body 13 includes an opening 15 into which the neck 14 is inserted. A gas-tight seal is formed between the inner periphery 17 of the opening 15 and the outer periphery 19 of the neck 14. The neck 14 is fitted with a check valve 22. A gas-tight seal is formed between the outer periphery 24 of the check valve 22 and the inner periphery 26 of the neck 14. The check valve 22 includes a valve pin or stem 28. The valve stem 28 is movable in a vertical direction along an axis 29. Generally, the valve stem 28 is retained in a sealing position, illustrated in FIG. 7, either by spring loading or by gas pressure within the cylinder 12. When the valve stem 28 is moved vertically from its sealing position to an open discharging position, as illustrated in FIG. 8, the check valve 22 opens to permit gas to flow from the cylinder 12.

Referring to FIGS. 3–6, The vent cap 10 includes an outer, annular base 30, an annular skirt 32 and an indicator 34. The indicator 34 includes a button 36 and a pin 38. The pin 38 includes a distal end 41 and a proximate end 35. The pin 38 joins the button 36 at the proximate end 35. The annular base 30 and the annular skirt 32 are preferably coaxial with a central axis 37. The vent cap 10, including the annular base 30, the annular skirt 32, the button 36 and the pin 38, is preferably molded from a single piece of plastic.

The annular skirt 32 is preferably sized to fit the outer perimeter 21 of the neck 14 of the propane cylinder 12 (FIGS. 1–2). The inner periphery 33 of the annular skirt 32 includes threads 39 adapted to engage the threads 18 of the neck 14 during axial and rotative motion of the vent cap 10 relative to the propane cylinder 12. The threads 39 form a fixation means for engaging the neck 14 and securing the vent cap 10 thereto. Preferably, the threads 39 are molded on only portions of the inner periphery of the annular skirt 32, such as portions 40*a*, 40*b* and 40*c* illustrated in FIGS. 5 and 6. Interspersed between threaded portions 40*a*, 40*b* and 40*c* are unthreaded portions 42*a*, 42*b* and 42*c*. When the vent cap 10 is secured to the neck 14 of the propane cylinder 12, the unthreaded portions 42*a*, 42*b*, 42*c* provide egress for gas or other fluid vented from the mouth 16 of the propane cylinder 12.

The annular skirt 32 projects from the annular base 30 in a direction generally parallel to the central axis 37. The annular base 30 joins the annular skirt 32 at the inner periphery 33 thereof. Reinforcing ribs 44*a*, 44*b*, 44*c*, 44*d*, 44*e* and 44*f* also join the top surface 46 of the annular base 30 to the annular skirt 32. On the bottom surface 48 of the annular base 30 are molded a plurality of ribs 50*a*, 50*b* and 50*c*, illustrated in FIG. 5. When the vent cap 10 is secured to the neck 14 of the propane cylinder 12, the ribs 50*a*, 50*b*, 50*c* establish an air gap between the neck 14 and the bottom surface 48. This provides an egress for gas or other fluid ventilated from the mouth 16 of the propane cylinder 12. The pin 38 includes a vent slot 52 in the distal end 41 of the pin 38, again to provide egress to gases or other fluids ventilated from the propane cylinder 12.

The pin 38 of the indicator 34 is adapted to selectively engage the valve stem 28 of the check valve 22, as is illustrated in FIGS. 7 and 8. As the indicator 34 is moved from a first or up position, as illustrated in FIG. 7, to a second or down position, as illustrated in FIG. 8, the pin 38 moves from a first or upmost position (FIG. 7) to a second or downmost position (FIG. 8). In the upmost position, the pin 38 does not engage the valve stem 28, so the valve stem 28 remains in the sealing position for sealing the mouth 16 to prevent escape of gas from the cylinder 12. In the downmost position, the pin 38 moves the valve stem 28 from the sealing position to a discharging open position for discharging gas from the cylinder 12.

Figure 6:
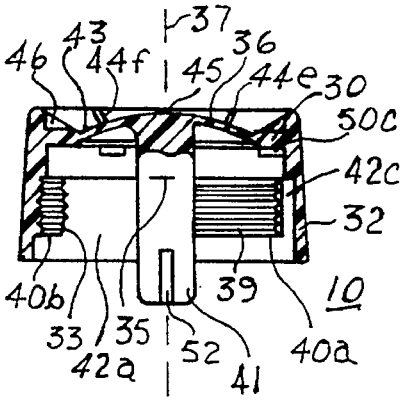
FIG. 6 is a cross-sectional view of the vent cap of FIGS. 1 and 2, taken along line 6—6 in FIG. 5.
Figure 5:
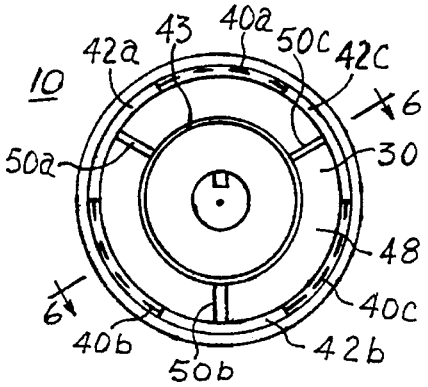
FIG. 5 is a bottom view of the vent cap of FIGS. 1 and 2.

As illustrated in FIGS. 5 and 6, the button 36 includes a flexible, radially curved central portion 56. The central portion 56 is configured to provide an "oil can" action. This oil can action is similar to the spring action at the circular bottom of an old-fashioned oil can. The curved central portion 56 is substantially circular and has a perimeter 43 and a center 45 coaxial with the central axis 37. The curved portion 56 curves along its radius from the perimeter 43 to an apex at the center 45.

When the indicator 34 is in the up position (FIG. 7), the central portion 56 is convex when viewed from above. In response to manual depression of the flexible central portion 56, the central portion 56 flexes and the indicator 34 moves from the up position to the down position (FIG. 8). In the down position, the central portion 56 is concave when viewed from above. When not acted upon by any outside force, such as manual pressure asserted from above or pressure applied to the pin 38 from below by the valve stem 28, the central portion 56 will remain in either the convex up position (FIG. 7) or the concave down position (FIG. 8). Consistent with oil can action, some external force is required to move the indicator from either of these bi-stable positions to the other. The external force or pressure required is determined by geometrical features such as the thickness of the central portion 56 and the angle formed by the central portion 56 relative to the annular base 30 when the central portion is either concave or convex.

In operation, the vent cap 10 may be secured to the neck 14 of the propane cylinder 12 when the propane cylinder 12 is substantially empty of pressurized gas. A user may determine the cylinder 12 is empty when the sloshing of liquid propane in the cylinders is no longer detected. The cylinder may still contain gaseous propane under pressure. The pressure of the remaining gas in the cylinder 12 may be insufficient to adequately operate an appliance attached to the cylinder 12. However, the pressure of the contents remaining in the cylinder 12 is generally unknown and may be as great as 150 PSI.

After the vent cap 10 has been secured to the neck 14 by screwing the vent cap onto the neck, the button 36 may be manually depressed using a finger or thumb. If the pressure of the gas remaining in the cylinder 12 is less than a predetermined threshold, depression of the button 36 will move the indicator 34 from the up position to the down position, moving the valve stem 28 of the check valve 22 from the sealing position to the open discharging position, allowing the gaseous contents of the cylinder 12 to be vented. If the gas pressure of the contents of the cylinder is less than a predetermined threshold, the button 36 will remain depressed due to the oil can action of the central portion 56. If the pressure of the contents of the cylinder 12 exceeds the predetermined threshold, the gas pressure on the valve stem 28, in contact with the pin 38, will force the indicator 34 back to the up position. Thus, if the pressure of the contents is too great, the vent cap 10 will not operate to automatically discharge the cylinder 12. If the pressure of the contents is sufficiently low, however, the vent cap 10 will maintain the check valve 22 open allowing the remaining contents of the cylinder 12 to be vented, emptying the cylinder. After the cylinder 12 has been emptied in this fashion, the cylinder 12 will be safe for operations such as recycling.

The predetermined threshold at which the indicator 34 will remain in the down position, despite the gas pressure applied to the pin 38, may be set to any convenient level, such as 60 PSI. This threshold is set by adjusting the geometrical configuration of the central portion 56 of the button 36.

The indicator 34 provides an indication of the discharge status of the cylinder 12. If the indicator 34 is in the down position, an indication is provided that the cylinder 12 has been discharged. The provided indication, the concave shape of the button 36, is both a visual and tactile indication.

Since the vent cap 10 is molded from material such as plastic, the vent cap 10 can be manufactured very inexpensively. Thus, vent caps such as the vent cap 10 may be mass produced and made commonly available for discharging nearly empty containers such as the propane cylinder 12. For example, each container such as the propane cylinder 12 could be sold with a vent cap such as the vent cap 10 removably attached to packaging materials. The user can be instructed that, when the container is substantially empty, the user should secure the vent cap to the container to fully discharge the container to permit subsequent recycling of the container. The vent cap assures that this discharging can be done safely with minimal risk.

While particular embodiments of the invention have been shown and described, modifications may be made. For example, the vent cap 10 may be used in conjunction with other types of containers which store fluids, including liquids, under pressure. Therefore, it is intended in the appended claims to cover all such changes and modifications which fall within the true spirit and scope of the invention.

We claim:

1. A cap for a fluid container, the fluid container having a neck ending in a mouth and a check valve for realeasibly sealing the mouth, the check valve including a valve stem, the valve stem having sealing position for sealing the mouth in response to fluid pressure in the container, the valve stem being moveable from the sealing position to a discharging open position for discharging the fluid from the container, the cap comprising:

fixation means for engaging the neck and securing the cap to the neck; and an indicator integrally formed with the fixation means, the indicator including a pin, the pin capable of engaging the mouth when the cap is secured to the neck, the indicator being manually moveable from a first position to a second position, the pin forcing the valve stem from the sealing position to the discharge open position when the indicator is in the second position, the indicator remaining in the second position when the fluid pressure of the fluid is less than a predetermined pressure above atmospheric pressure, the indicator moving to the first position when the fluid pressure of the fluid is at least equal to the predetermined pressure.

2. A cap for a fluid container as defined in claim 1 wherein the indicator further includes a button integrally formed with the pin, the button being depressible to move the indicator from the up position to the second position.

3. A cap for a fluid container as defined in claim 2 wherein the valve stem is moveable along an axis and the pin is substantially coaxial with the valve stem when the cap is secured to the neck, the pin moving from the first position toward the second position along the axis when the button is depressed.

4. A cap for a fluid container, the fluid container having a neck ending in a mouth and a check valve for realeasibly sealing the mouth, the check valve including a valve stem, the valve stem having sealing position for sealing the mouth in response to fluid pressure in the container, the valve stem being movable from the sealing position to a discharging open position for discharging the fluid from the container, the cap comprising:

fixation means for engaging the neck and securing the cap to the neck; and an indicator integrally formed with the fixation means, the indicator including a pin, the pin engaging the mouth when the cap is secured to the neck, the indicator being manually moveable between a first position to a second position, the pin moving the valve stem from the sealing position when the indicator is in the second position, the indicator remaining in the second position when the fluid pressure of the fluid is less than a predetermined pressure, the indicator moving to the first position when the fluid pressure of the fluid is at least equal to the predetermined pressure, wherein the indicator further includes a button integrally formed with the pin, the button being depressible to move the indicator from an up position, wherein the valve stem is moveable along an axis and the pin is substantially coaxial with the valve stem when the cap is secured to the neck, the pin moving from the first position toward the second position along the axis when the button is depressed, wherein the button includes a flexible, radially curved central portion, the central portion flexing when the button is depressed to move the pin from the first position toward the second position along the axis.

5. A cap for a gas container as defined in claim 4 wherein the central portion flexes to provide an oil can effect when the button is depressed.

6. A cap for a gas container as defined in claim 5 wherein fluid pressure in the container returns the valve stem to the sealing position when the fluid pressure of gas exceeds the predetermined pressure threshold, the valve stem engaging the pin to move the indicator from the second position to the first position.

7. A cap for a fluid container as defined in claim 6 wherein the pin has a proximate end adjacent the button and a distal end, the distal end of the pin engaging the valve stem when the indicator moves from the first position to the second position and wherein the pin includes a vent slot in a distal end of the pin.

8. A cap for a fluid container as defined in claim 7 wherein the fixation means includes an annular base joined to the button at the periphery of the button and wherein the base has an outer surface and an inner surface, the inner surface engaging the neck when the cap is secured to the neck and wherein the base includes a spacer, the spacer forming an air gap between the inner surface and the neck.

9. A cap for a fluid container as defined in claim 8 wherein the spacer comprises a plurality of ribs arranged on the inner surface.

10. A cap for a fluid container, the fluid container having a cylindrical neck ending in a mouth, the neck having a set of outer threads on an outer periphery thereof, the cap comprising:

an annular base oriented about a central axis;

an annular skirt oriented about the central axis and projecting from the outer annual base generally parallel to the central axis, the annular skirt being sized to fit the outer periphery of the neck and having a set of inner threads on an inner periphery of the annular skirt for engaging the set of outer threads; and an indicator including a button and a pin substantially coaxially disposed on the central axis within the annular base at the perimeter of the button, the button including a flexible radially curved portion, the pin having a proximate end and a distal end, the proximate end joining the button, the pin being substantially normal to the button and substantially parallel to the central axis, the indicator being moveable along the central axis between an up position and a down position in response to flexing of the radially curved portion.

11. A cap for a fluid container as defined in claim 10 wherein the radially curved portion and provides an oil can effect when the indicator is moved between the up position and the down position.

12. A cap for a fluid container as defined in claim 11 wherein the radially curved portion is substantially circular and has a perimeter and a center coaxial with the central axis, and wherein the radially curved portion curves from the perimeter to an apex at the center.

13. A cap for a fluid container as defined in claim 12 wherein the apex moves from a first position distal the mouth to a second position proximate the mouth when the indicator is moved between the up position and the down position.

14. A cap for a fluid container as defined in claim 10 wherein the annular base has an outer surface and an inner surface, the inner surface being proximate the pin, the inner surface including a plurality of raised ribs.

15. An integral plastic cap for a flammable fluid container, the fluid container having an opening disposed in a cylindrical neck, the opening including a valve releasably sealing the opening of the fluid container, the valve being in a sealing position for sealing the opening in response to a fluid pressure of a fluid in the fluid container, the valve being moveable to a discharge position for discharging the fluid from the fluid container, the integral plastic cap comprising:

an integral skirt being sized to fit the cylindrical neck of the gas container; and an integral bi-stable indicator including a valve member and a bias element, the integral bi-stable indicator being moveable to a first position wherein the valve member forces the valve to the discharge position and a second position wherein the valve member allows the valve to reach the sealing position, wherein the integral bi-stable indicator is manually moveable from the second position to the first position so the valve member engages the valve and forces the valve to the discharge position when the fluid pressure of the fluid in the fluid container is below a predetermined threshold above atmospheric pressure, the bias element holding the integral bi-stable indicator in the first position when the fluid pressure of the fluid in the fluid container is below the predetermined threshold above atmospheric pressure, the integral bi-stable indicator remaining in the second position when the gas pressure is equal to or above the predetermined threshold, the integral bi-stable indicator thereby indicating whether the fluid container contains the fluid.

16. The integral plastic cap of claim 15 wherein the bias element has oil can action.

17. The integral plastic cap of claim 15 wherein the bias element includes a flexible, radially curved central portion, the central portion flexing when the bias element is depressed to move the integral bi-stable indicator to the second position.

18. The integral plastic cap of claim 17 wherein the valve member is a plastic pin.

19. The integral plastic cap of claim 18 wherein the valve is a check valve having a needle and the plastic pin punches against the needle of the check valve.

20. The integral plastic cap of claim 19 wherein the bias element of the integral bi-stable indicator is viewable so that the position of the integral bi-stable indicator can be ascertained.

* * * * *